US011401774B2

(12) United States Patent
Moyes

(10) Patent No.: US 11,401,774 B2
(45) Date of Patent: Aug. 2, 2022

(54) SEAL ARRANGEMENT

(71) Applicant: XTREME WELL TECHNOLOGY LIMITED, Banchory (GB)

(72) Inventor: Peter Moyes, Banchory (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 269 days.

(21) Appl. No.: 15/127,518

(22) PCT Filed: Mar. 20, 2015

(86) PCT No.: PCT/GB2015/050845

§ 371 (c)(1),
(2) Date: Sep. 20, 2016

(87) PCT Pub. No.: WO2015/140579

PCT Pub. Date: Sep. 24, 2015

(65) Prior Publication Data

US 2017/0130552 A1 May 11, 2017

(30) Foreign Application Priority Data

Mar. 20, 2014 (GB) ..... 1405009

(51) Int. Cl.
*E21B 33/128* (2006.01)
*E21B 33/129* (2006.01)
*E21B 23/01* (2006.01)

(52) U.S. Cl.
CPC ..... *E21B 33/128* (2013.01); *E21B 23/01* (2013.01); *E21B 33/129* (2013.01)

(58) Field of Classification Search
CPC ..... E21B 33/128; E21B 23/01; E21B 33/129
See application file for complete search history.

(56) References Cited

U.S. PATENT DOCUMENTS 4,765,404 A 8/1988 Bailey et al.
4,791,992 A * 12/1988 Greenlee ..... E21B 33/128 166/187

(Continued)

FOREIGN PATENT DOCUMENTS

GB 2497124 A * 6/2013 ..... E21B 33/128
GB 2497124 A 6/2013

(Continued)

OTHER PUBLICATIONS

International Search Report and Written Opinion issued in related PCT/GB2015/050845, dated Jul. 2, 2015 (10 pages).

(Continued)

*Primary Examiner* — Eugene G Byrd
(74) *Attorney, Agent, or Firm* — Ashley E. Brown

(57) ABSTRACT

A sealing method and sealing arrangement is described. The sealing arrangement comprises a body and first and second sealing elements mounted thereon. The sealing elements are each movable between a retracted configuration and an extended configuration and are configured to move from the retracted configuration to the extended configuration in response to an axial compression. The second sealing element is however maintained in its retracted configuration until the first sealing element has moved from its retracted configuration to its extended configuration. The sequential extension of the sealing elements can deform to assume the extended configuration under compression and the progression and the form of the deformation can be arranged to improve the quality of the seal achieved. An extended sealing element in engagement with the bore wall may also serve as an anchor or retainer and facilitate application of a compression force to an intermediate sealing element.

30 Claims, 12 Drawing Sheets

(56) References Cited

U.S. PATENT DOCUMENTS 5,467,822 A * 11/1995 Zwart ..... E21B 33/12 166/179
7,322,416 B2 * 1/2008 Burris, II ..... E21B 23/00 166/308.1
8,561,709 B2 * 10/2013 Arce ..... E21B 33/1208 166/387
8,727,027 B2 * 5/2014 Schilte ..... E21B 33/1208 166/180
8,887,818 B1 * 11/2014 Carr ..... E21B 33/1204 166/118
9,145,755 B2 * 9/2015 Farquhar ..... E21B 23/06
9,376,884 B2 * 6/2016 Clarke ..... E21B 33/1208
2003/0079887 A1 * 5/2003 Lloyd ..... E21B 33/128 166/387
2005/0161232 A1 * 7/2005 Patel ..... E21B 33/128 166/386
2008/0053652 A1 3/2008 Corre et al.
2008/0061510 A1 3/2008 Li et al.
2009/0058017 A1 * 3/2009 Harper ..... E21B 33/1212 277/614
2009/0205843 A1 8/2009 Gandikota et al.
2009/0255692 A1 * 10/2009 Coronado ..... E21B 33/128 166/387
2011/0062670 A1 3/2011 Allen
2011/0186308 A1 * 8/2011 Xu ..... E21B 33/128 166/387
2012/0006530 A1 * 1/2012 Crabb ..... E21B 33/134 166/129
2012/0273236 A1 * 11/2012 Gandikota ..... E21B 23/01 166/382
2013/0112398 A1 * 5/2013 White ..... E21B 33/1216 166/118
2013/0140041 A1 * 6/2013 Allen ..... F16L 25/14 166/387
2013/0147121 A1 * 6/2013 Xu ..... E21B 33/128 277/337
2013/0180732 A1 * 7/2013 Acosta ..... E21B 23/06 166/387
2013/0192853 A1 * 8/2013 Themig ..... E21B 33/1216 166/387
2013/0299199 A1 * 11/2013 Naedler ..... E21B 33/13 166/386
2015/0252647 A1 * 9/2015 Liu ..... E21B 23/06 166/124

FOREIGN PATENT DOCUMENTS

WO 2013079965 A2 6/2013
WO 2014006392 A2 1/2014

OTHER PUBLICATIONS

International Preliminary Report on Patentability issued in related PCT/GB2015/050845, dated Sep. 20, 2016 (7 pages).
Combined Search and Examination Report issued in the related GB Application 1504798.8, dated Jul. 1, 2015 (8 pages).
Examination Report issued in the related GB Application 1504798.8, dated Jan. 19, 2017 (4 pages).
Examination Report issued in the related GB Application 1504798.8, dated Jul. 7, 2017 (4 pages).
Communication pursuant to Article 94(3) EPC, issued in the related EP Application 15718075.3, dated Nov. 8, 2017 (3 pages).
Examination report issued in the related AU Application 2015233160, dated Aug. 30, 2018 (4 pages).
Metaplex seal, published on Oct. 17, 2013, available from: https://www.youtube.com/watch?v=XZUt-Lrafc0, Accessed on Jun. 23, 2015, (Xtreme Well Technology), 16-31 Seconds—(details of the videos are as provided in the GB combined search and examination report dated Jul. 1, 2015 listed in this IDS, line 3 under NPL).
Metaplex seal, published on Oct. 17, 2013, available from: https://www.youtube.com/watch?v=6dNS2JdvZBQ, Accessed on Jun. 23, 2015, (Xtreme Well Technology), Whole Video—(details of the videos are as provided in the GB combined search and examination report dated Jul. 1, 2015 listed in this IDS, line 3 under NPL).
Exam Report issued in Canadian Patent Application No. 2943276 dated Apr. 13, 2021, 4 pages.
Exam Report issued in Canadian Patent Application No. 2943276 dated Jan. 6, 2022, 7 pages.

* cited by examiner

SEAL ARRANGEMENT

This application is the U.S. national phase of International Application No. PCT/GB2015/050845 filed 20 Mar. 2015 which designated the U.S. and claims priority to GB Patent Application No. 1405009.0 filed 20 Mar. 2014, the entire contents of each of which are hereby incorporated by reference.

FIELD OF THE INVENTION

This invention relates to a seal arrangement. The arrangement may have utility in providing a seal in a downhole environment.

BACKGROUND OF THE INVENTION

In industries where bores are drilled in the earth to access subsurface formations, such as oil and gas exploration and production, there is often a desire or requirement to provide a seal between adjacent components, for example between the bore wall and a tubular extending through the bore. Such seals, sometimes referred to as packers, are run into a wellbore in an initial configuration in which the outside diameter of the seal is smaller than the minimum internal diameter of the wellbore. On reaching the appropriate location, the seal may be activated and expanded or extended into sealing contact with the surrounding wellbore wall, typically formed of metal tubing in the form of casing or liner. The expansion or extension may be achieved by a variety of mechanisms, including axial compression of a seal element, which forces the element to deform and bulge outwards.

The applicant has proposed a number of different seal arrangements, details of which are described in International patent application publication numbers WO2014/006392 and WO2013/079965, the disclosures of which are incorporated herein in their entirety.

SUMMARY OF THE INVENTION

According to an aspect of the present invention there is provided a sealing method comprising: providing a seal arrangement comprising first and second sealing elements mounted on a body; positioning the seal arrangement in a bore with the sealing elements in a retracted configuration; axially compressing the sealing elements and extending the first sealing element to an extended configuration while maintaining the second sealing element in the retracted configuration; and further axially compressing the sealing elements and extending the second sealing element to an extended configuration.

According to another aspect of the present invention there is provided a seal arrangement comprising a body and first and second sealing elements mounted thereon, the sealing elements each being movable between a retracted configuration and an extended configuration and being configured to move from the retracted configuration to the extended configuration in response to axial compression, the second sealing element being maintained in the retracted configuration until the first sealing element has moved from the retracted configuration to the extended configuration.

The various features discussed and described below may be provided in combination, individually or collectively, with one or both aspects of the invention, as appropriate.

The sequential extension of the sealing elements may provide a number of advantages. For example, the sealing elements may deform to assume the extended configuration under compression and the progression and form of the deformation may have a bearing on the quality of the seal achieved by the arrangement; by controlling the order of sealing element extension, the progression and nature of the extension may be more closely or accurately controlled. Alternatively, or in addition, the compression force may be applied from one end of the arrangement and the premature extension of an intermediate sealing element may restrict the ability to transfer that compression force to a retracted sealing element on the other side of the extended sealing element. Also, an extended sealing element in engagement with the bore wall may serve as an anchor or retainer and facilitate application of a compression force to an intermediate sealing element.

The second sealing element may be maintained in a fully retracted configuration until the first sealing element has been fully extended. Alternatively, the second sealing element may undergo a degree of movement towards the extended configuration prior to the first sealing element moving to the fully extended configuration.

The second sealing element may be maintained in the retracted configuration by an axial support member. The support member may restrict axial compression of the element or may permit an axial compression force to bridge or bypass the element. The axial support member may include a releasable or reconfigurable portion, for example a fastener or linkage which shears or otherwise releases on experiencing a predetermined force. Thus, the axial support element may comprise a shear sleeve, ring, pin or screw. The predetermined force may be selected to be greater than the force required to fully extend the first sealing element. Alternatively, or in addition, an element of the axial support member may be reconfigured on a predetermined axial translation of a portion of the first sealing element, consistent with the full extension of the first sealing element. The axial support member may extend between the body and the second sealing element, and may engage an end portion of the first sealing element.

In their respective extended configurations the first and second sealing elements may engage the bore wall.

The first and second sealing elements may be compliant, that is the sealing elements may be configured to provide contact, which may be a sealing contact, with bore walls of a range of diameters.

The first and second sealing elements may cooperate when both elements are extended to create a unitary seal such that, for example, an external fluid pressure force experienced and resisted by the extended first sealing element is also resisted by the extended second sealing element.

The first and second sealing elements may be symmetrical about a lateral plane, and may be provided in a back-to-back arrangement.

Each sealing element may comprise a number of components, including an axially and circumferentially extending member having a form selected such that the member may deform or buckle on experiencing a predetermined compressive force. Each sealing element may be configured such that the member deforms in a predetermined manner. Each sealing element may be configured such that the member undergoes plastic deformation as the seal element is extended. The member may be formed of any suitable material, typically a metal, and the metal member may engage the bore wall when the element is fully extended. Thus, when located in a metal-lined bore, the arrangement may provide a metal-to-metal seal. Ends of the member may be fixed or anchored such that the ends are not radially translated as the member deforms, however one or both ends may be axially movable relative to the body. The members may be mounted between end rings, and the members may share a common end ring. One or both ends of the member may be located towards the outer diameter of the arrangement, such that the radial distance between the end and the portion of the extended member in contact with the bore wall is minimised; at least one face of the member may be unsupported over this distance, sometimes referred to as the "extrusion gap", and the robustness of a sealing element is generally improved if this gap is smaller. The retracted member may extend radially outwards from the ends of the member.

Both of the axially and circumferentially extending members may be formed from a single piece of material, which may incorporate end rings. Typically, the members and end rings will be machined from a single metal tube, which facilitates maintaining the integrity of the members as the seal elements are extended, provides a better degree of predictability in relation to the behaviour of the metal in response to setting forces and pressure forces, and minimises the number of potential leak paths through the seal arrangement.

An internal surface of the axially and circumferentially extending member may be spaced from an outer surface of the body to define a volume, which volume may be filled with a deformable material, typically a non-compressible but compliant material, such as PTFE. The presence of the filler facilitates the desired deformation and extension of the member, tending to support radially outwards deformation and minimising the risk of the member buckling inwards, away from the bore wall. The filler may also assist in maintaining the structural integrity of the member during deformation and following setting of the seal arrangement.

In an alternative embodiment, the seal arrangement may comprise a seal located at both extremities that provides a means for sealingly engaging both outer extremities of the seal arrangement to a mandrel. This configuration presents a full annular piston to area to differential pressure from either direction, thus effectively: further axially compressing the sealing elements into increased sealing engagement with the bore wall; presenting a collapsing pressure regime to the seal arrangement which is fully supported in collapse due to the PTFE filled void, and removes the potential for a burst regime on the first sealing element when the deployed the seal arrangement is exposed to an uphole differential pressure.

In an alternative embodiment the defined volume may only be partially filled with a deformable material, typically a non-compressible but compliant material, such as PTFE. By only partially filling the defined volume the compression force required to set the sealing element may be reduced or may enhance the final deformed shape of increase the range of radial expansion.

The remainder of the volume may be filled or partially filled with a fluid such as oil, grease, silicone or other similar fluid. The presence of the fluid helps to prevent mechanical failure of the sealing element due to hydrostatic pressures experienced during deployment of the seal arrangement.

The sealing element may comprise a vent. The vent provides a means of fluid communication to and from the defined volume thus providing a pressure equalising conduit to prevent failure due to hydrostatic pressures. The vent may act as an exhaust for the fluid e.g. grease during compression of the sealing element. Ejection of the grease during the compression process has the advantage of proving a means for flushing away unwanted fluids (e.g. well fluids) and solid debris from the seal apparatus. The presence of the grease acts a lubricant during extension thus reducing the setting friction and enhancing the lifetime of the seal apparatus. The fluid may act to pack off into voids and imperfections within the bore wall and improve the overall sealing performance.

A travel limiter may also be located within the defined volume. The travel limiter provides a means for preventing over extension of the axially and circumferentially extending member. The travel limiter may comprise a solid ring, a split ring, segments or rods.

An outer surface of the axially and circumferentially extending member may carry a band or volume of compressible material, such as an elastomer, arranged to engage the bore wall when the sealing element is fully extended. Thus, in certain embodiments, an extended sealing element may provide a composite seal with both metal and elastomer components in sealing contact with a surrounding bore wall. The first and second sealing elements may cooperate in the extended configuration to form a seal comprising an elastomer central portion and metal end portions. The compressible material, or indeed any other compressible elements provided on the member, may be configured to facilitate a predetermined deformation of the axially and circumferentially extending member, for example to maintain a minimum bend radius at an end of the member. Each sealing element may include a substantially non-deformable portion to support at least a portion of the compressible material, or otherwise limit or control deformation of the material. Where the sealing elements are provided in a back-to-back arrangement, the elements may share a common non-deformable portion, which may take the form of a central circumferential rib. The compressible material may have a generally triangular section. In a retracted sealing element, an outer surface of the compressible material may be substantially cylindrical, while an inner surface of the material follows the outer surface of the respective axially and circumferentially extending member. Alternatively, the outer surface of the compressible material may comprise a non-uniform profile (e.g. a tapered profile) that provides a means for biasing the deformation of the compressible material during setting of the sealing element.

Each axially and circumferentially extending member may include a circumferentially-extending outer lip, which may be integral with the member. The lip may be configured to provide a small area high pressure contact with the bore wall when the element is fully extended. Thus, the lip may deform on engaging the bore wall, and may improve anchoring and sealing of the element with the bore wall. The lip may also serve to retain a compressible material. When used in downhole applications in lined bores, with the lip being formed of the same relatively deformable ductile material as the axially and circumferentially extending member, the lip may preferentially deform against the relatively non-ductile casing.

The body may take any appropriate form, and may be a tubular component or a mandrel. The body may be configured to form part of a tubular string, for example a completion, or may be configured to be run into a borehole on a reelable support, such as coiled tubing or wireline.

The axial compression of the sealing elements may be achieved by any appropriate mechanism, for example by applying a compressive force to one end of a portion of the seal arrangement containing the sealing elements, with the other end of the portion being fixed to the body. The compressive force may be generated by any appropriate means, for example using fluid pressure or any conventional downhole actuator.

The seal arrangement may be configured to hold pressure from one or both sides. In one embodiment the arrangement is intended to present the first sealing element on the high pressure side, which may correspond to the downhole side.

The seal arrangement may include a locking arrangement, such as a ratchet, to retain the arrangement in a set configuration. The seal arrangement may be releasable from the set configuration, to permit the sealing elements to at least partially retract.

BRIEF DESCRIPTION OF THE DRAWINGS

These and other aspects of the invention will now be described, by way of example only, with reference to the accompanying drawings, in which.

DETAILED DESCRIPTION OF THE DRAWINGS

Figure 1:
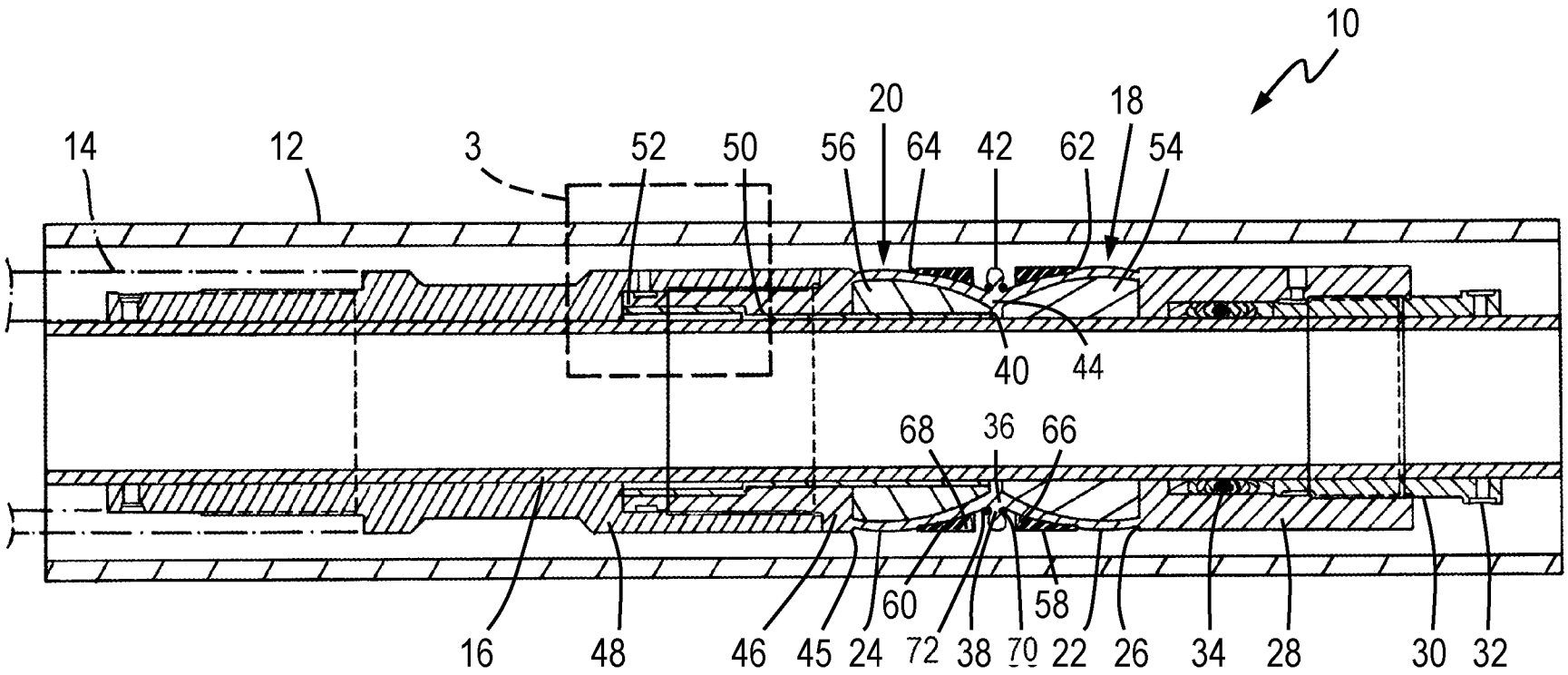
FIG. 1 is a sectional view of a seal arrangement in accordance with a first embodiment of the present invention, in an unset configuration.

Reference is first made to FIG. 1 of the drawings, which is a sectional view of a seal arrangement 10 in accordance with a first embodiment of the present invention. The seal arrangement 10 is illustrated in an unset configuration. Embodiments of the present invention may be utilised in a range of environments and applications, however the embodiments described herein are primarily intended in use of downhole applications, and as such may be employed in the oil and gas exploration and extraction industry. Thus, the seal arrangement 10 is illustrated located within bore-lining tubing, which in this example is metal casing 12. As is conventional, the left-hand end of the Figure is representative of the upper or uphole end, while the right-hand end of the Figure is representative of the lower or downhole end.

In use, the sealing arrangement 10 will be provided in combination with an actuating arrangement, which would typically be located to the uphole end of the arrangement 10. In FIG. 1, only the lower end of an actuating mechanism is indicated by chain dotted lines 14.

The seal arrangement 10 comprises a tubular body in the form of a mandrel 16 which may form part of a tubular string, or which may form part of a discrete tool or device. Mounted on the mandrel 16 are first and second sealing elements 18, 20. As will be described, the lower end of the first sealing element 18 is fixed to the mandrel 16, while other parts of the first sealing element 18 and the second sealing element 20 may be axially moveable relative to the mandrel 16, and may be moved towards the lower end of the first sealing element 18 by the actuating arrangement 14.

Each sealing element, 18, 20 includes an axially and circumferentially extending metal member 22, 24 having a form selected such that the member 22, 24 will deform or buckle on experiencing an axially compressive setting force. The member 22 of the first sealing element 18 has a lower end 26 coupled to a ring or mandrel 28 fixed to an inner sleeve 30 which is itself fixed and sealed to the outer surface of the mandrel 16 by set screws 32 and a chevron seal 34.

An upper end 36 of the member 22 is joined to a ring 38 which extends around the mandrel 16 and features an inwardly extending annular lip 40 and an outwardly extending annular rib 42.

The member 24 of the second sealing element 20 is essentially a mirror image of the member 22, having a lower end 44 attached to the ring 38 and an upper end 45 attached to an end ring 46 which, unlike the end ring 28, is axially moveable on the mandrel 16, as will be described. The axially and circumferentially extending members 22, 24, the end rings 28, 46 and the central ring 38 are formed from a single piece of metal.

The end ring 46 is threaded and pinned to the lower end of a setting mandrel 48, the upper end of which is threaded and pinned to the lower end of the actuating arrangement 14. In the unset configuration as illustrated in FIG. 1, an axial support member in the form of a shear sleeve 50 extends between a shoulder 52 on the setting mandrel 48 and the upper face of the annular lip 40.

The inner surfaces of the members 22, 24 and the respective end rings 28, 38, 46 in combination with the outer surface of the mandrel 16 define respective enclosed volumes 54, 56 which are occupied by a non-compressible but compliant material such as polytetrafluoroethylene (PTFE), such as is sold under the Teflon trademark.

Each member 22, 24 has a generally bulbous form and extends radially inwardly between the respective end rings 28, 46 and the central ring 38, creating a generally triangular-section volume between the outer surface of each member 22, 24 and the rib 42. Each volume is at least partially occupied by a generally triangular-section rubber ring 58, 60, such that each ring 58, 60 has a generally cylindrical outer surface. The smaller section ends of each ring 58, 60 engage respective circumferential lips 62, 64 formed on the outer surface of the members 22, 24. The larger section ends of each ring 58, 60 are shaped to engage and co-operate with the rib 42 as the seal arrangement 10 is set, as will be described. Although the surfaces of the rings 58, 60 and the rib 42 are initially spaced apart, as the seal arrangement 10 is set the surfaces move together and into contact, and as such the rings 58, 60 may include respective fluid release ports 66, 68 to prevent fluid becoming trapped between the surfaces.

As will be described, the member ends 36, 44 experience bending as the seal arrangement 10 is set, and to facilitate maintenance of an acceptable bend radius between the member ends 36, 44 and the central ring 38, O-rings 70, 72 are located on the outer surface of the members 22, 24 between the ends 36, 44 and the base of the rib 42.

Figure 2:
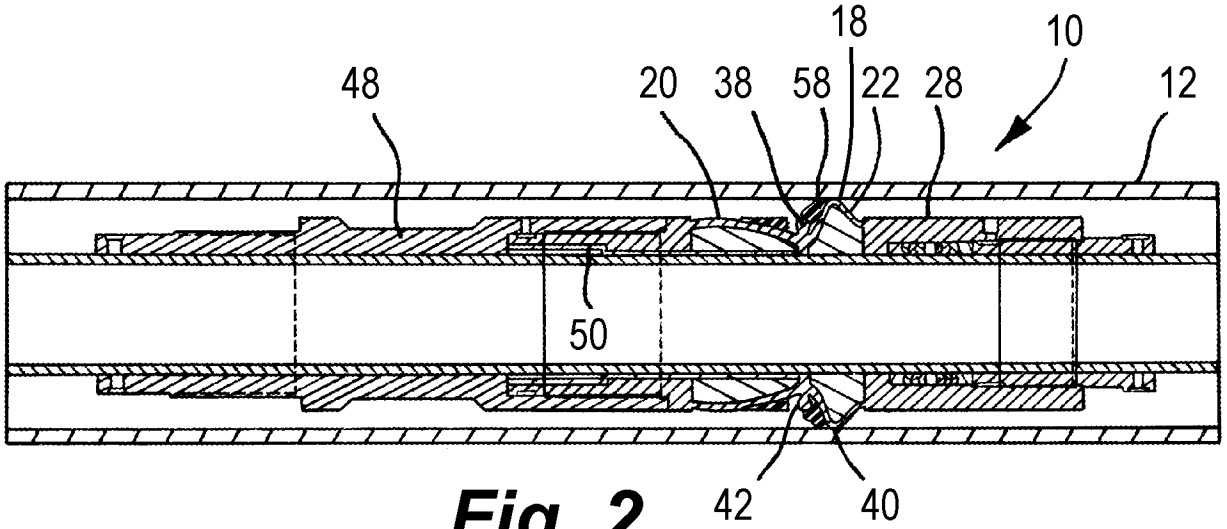
FIG. 2 shows the seal arrangement of FIG. 1, in a partially set configuration.

Reference is now also made to FIG. 2 of the drawings, which illustrates the seal arrangement 10 in a partially-set configuration. In particular, on application of a downward compressive force by the actuating arrangement 14, the setting mandrel 48 is urged downwardly relative to the mandrel 16. This compressive force is transferred directly from the setting mandrel 48 to the central ring 38 via the shear sleeve 50. Thus the second sealing element 20 does not initially experience any compression. However, the first sealing element 18 is compressed and will deform as illustrated in FIG. 2, that is the central ring 38 moving towards the lower end ring 28, resulting in buckling of the member 22, pushing the outer surface of the member 22 radially outwards into contact with the casing 12. The member 22 is configured such that the annular lip 40 engages the casing 12, the relatively small contact area provided by the lip 40 creating a high pressure zone which tends to deform the lip 40 preferentially against the casing wall, thus anchoring and sealing the member 22 to the casing 12. It will also be noted that the thinner section end of the rubber ring 58 has been pushed outwardly into contact with the casing 12, while the thicker section end of the ring 58 has been pushed into contact with and over the top of the rib 42.

Figure 3:
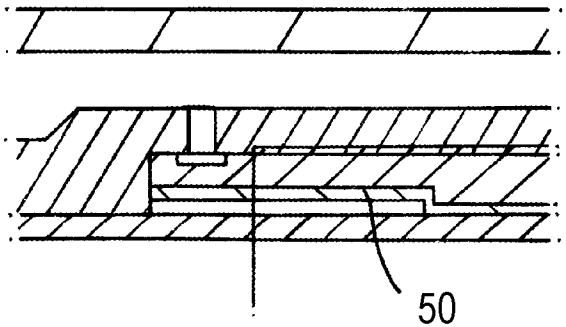
FIG. 3 is an enlarged sectional view of area 3 of FIG. 1, showing a shearable setting arrangement.
Figure 4:
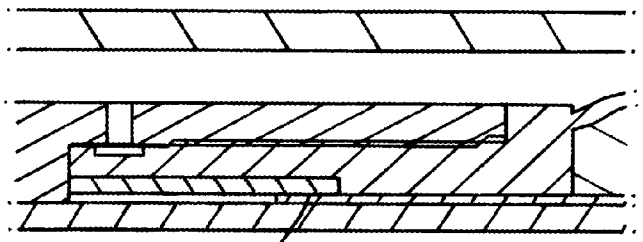
FIG. 4 shows the setting arrangement of FIG. 3, after shearing.
Figure 5:
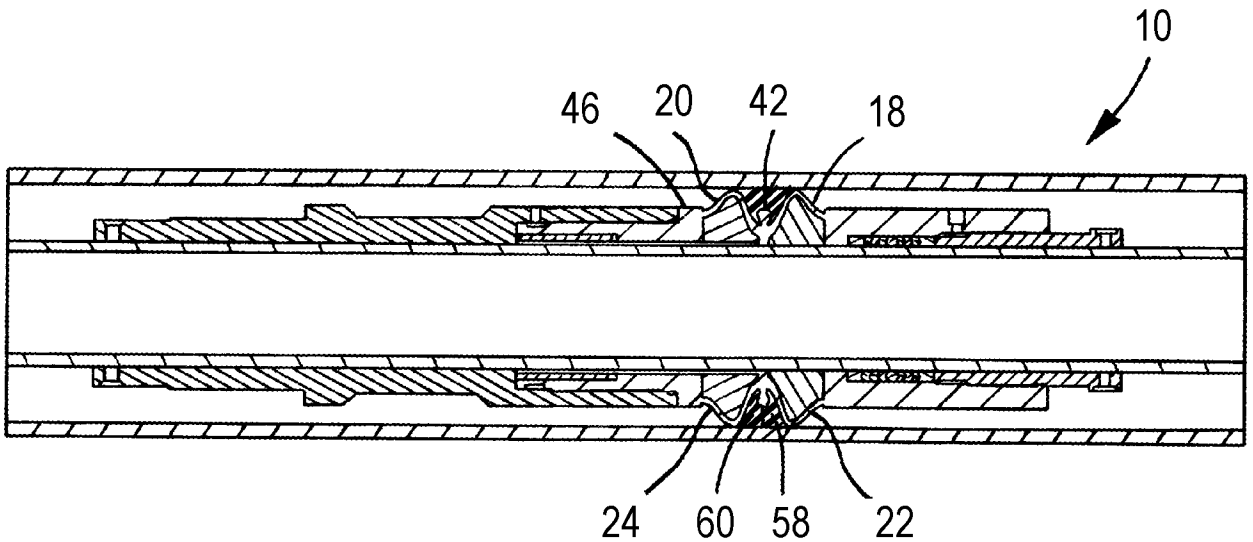
FIG. 5 shows the seal arrangement of FIG. 1, in a fully set configuration.

Once the first sealing element 18 has been fully set, as illustrated in FIG. 2, application of further compressive force causes the shear sleeve 50 to fail, FIGS. 3 and 4 of the drawings illustrating the configuration of the sleeve 50 before and after failure. Once the sleeve 50 has sheared, the setting force applied by the setting mandrel 48 bears on the end ring 46, compressing and extending the second sealing element 20 in a similar manner to the previously set first sealing element 18. The fully-set sealing arrangement 10 is illustrated in FIG. 5 of the drawings.

It will be observed that the set sealing elements 18, 20 are substantially symmetrical about a lateral plane and that the rubber rings 58, 60 have been pressed together to form a generally V-section rubber seal element.

During and following setting, the annular rib 42 controls and supports the rings 58, 60, and in turn the rings 58, 60 support and control the deformation of the members 22, 24.

Figure 6:
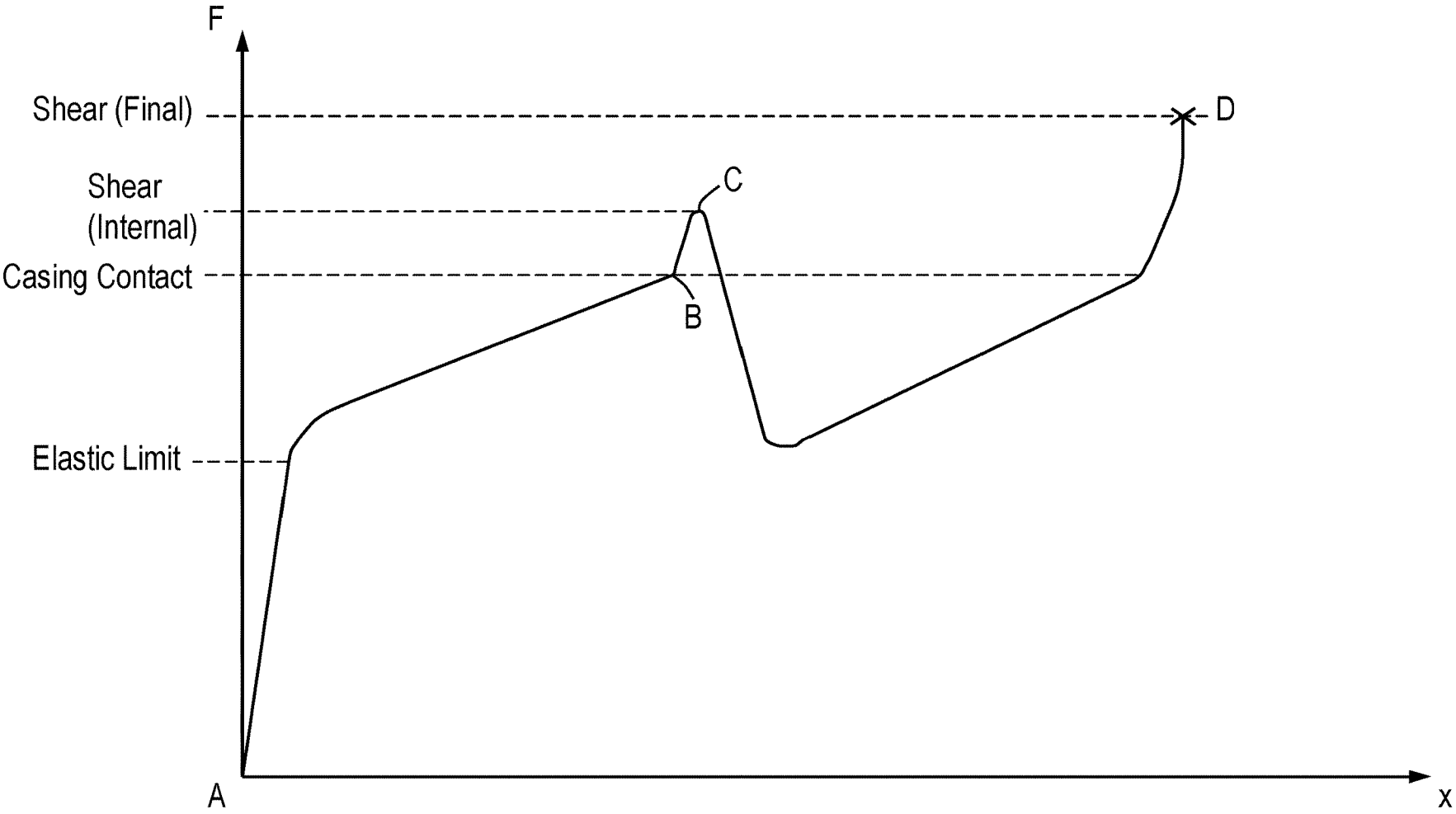
FIG. 6 is a graph illustrating the relationship between the setting force applied to the sealing elements of the seal arrangement of FIG. 1, and the degree of compression of the sealing elements.
Figure 7:
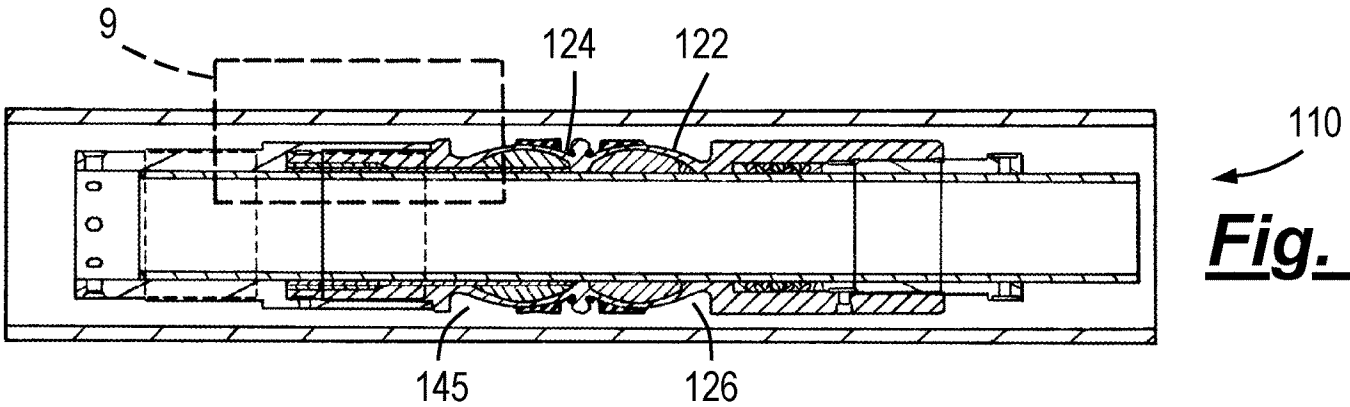
FIG. 7 is a sectional view of a seal arrangement in accordance with a second embodiment of the present invention, in an unset configuration.
Figure 8:
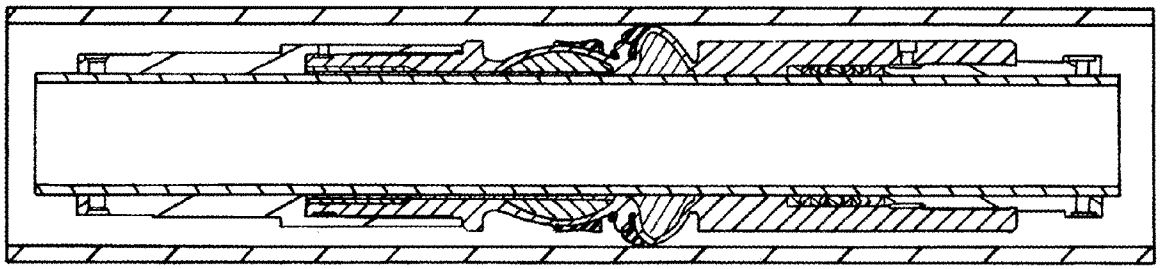
FIG. 8 shows the seal arrangement of FIG. 7, in a partially set configuration.
Figure 9:
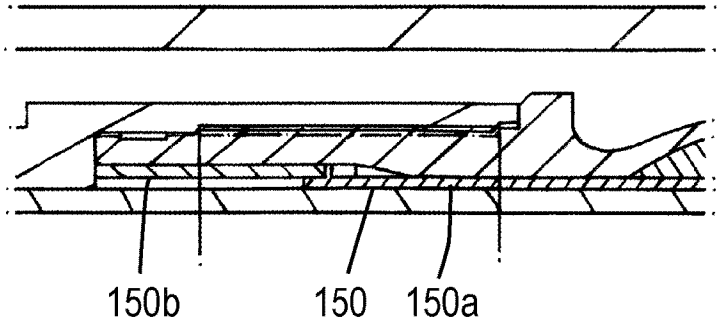
FIG. 9 is an enlarged sectional view of area 9 of FIG. 7, showing a shearable setting arrangement.
Figure 10:
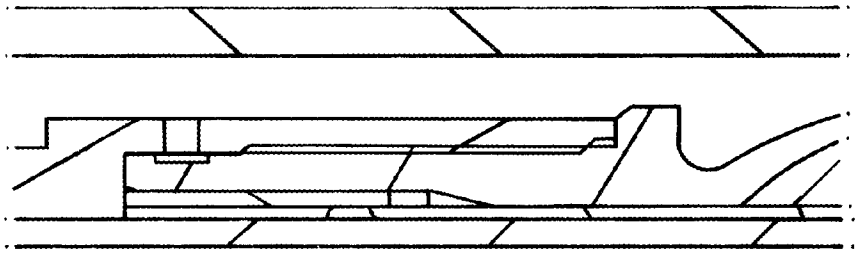
FIG. 10 shows the setting arrangement of FIG. 9, after shearing.
Figure 11:
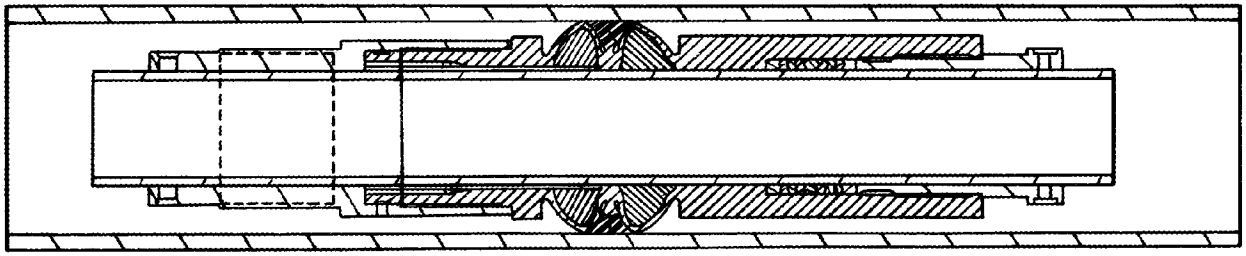
FIG. 11 shows the seal arrangement of FIG. 7, in a fully set configuration.

Reference is now also made to FIG. 6 of the drawings, which is a graph illustrating the relationship between the setting force applied to the sealing elements 18, 20 and the degree of compression of the sealing elements. The section of the graph between points A and B illustrates initial compression of the first sealing element 18, comprising an initial degree of elastic deformation followed by plastic deformation until the outer surface of the member 22 contacts the casing at point B. This is followed by a further degree of compression, which effectively energises the element 18. When the first sealing element 18 is fully set, at point C, the shear sleeve 50 fails, resulting in initiation of the setting of the second sealing element 20. At this point the compressive setting force is being applied to both sealing elements 18, 20, however as the first sealing element 18 is already fully-set, all of the associated deformation will be accommodated by the second sealing element 20, until the element 20 is fully set, at point D.

The seal arrangement 10 may be retained in the set position by, for example, providing a ratchet arrangement on the actuating arrangement 14. Subsequently the ratchet arrangement may be released, allowing the sealing elements 18, 20 to be at least partially retracted, to permit retrieval of the seal arrangement 10 from the bore.

In the above described embodiment it will be noted that the first member lower end 26 and the second member upper end 45 are positioned towards the outer diameter of the respective end rings 28, 46. This offers the advantage that the distance between the member ends 26, 45 and the wall of the casing 12 is relatively small. This distance, sometimes referred to as the extrusion gap, has a bearing on the ability of the seal to withstand higher pressures, in general a smaller distance being associated with enhanced pressure-holding capabilities.

Reference is now made to FIG. 7 through 11 of the drawings, which illustrate a sealing arrangement 110 in accordance with a second embodiment of the present invention. The seal arrangement 110 shares many features with the seal arrangement 10 described above, and in the interests of brevity those common features will not be described again in any detail.

It will be noted that the axially and circumferentially extending members 122, 124 have a slightly different form, in that the first member lower end 126 and the second member upper end 145 are positioned radially inwardly as compared to the corresponding ends 26, 45 of the members 22, 24 of the first embodiment.

It will also be noted that the shear sleeve 150 of the second embodiment, rather than being a one piece member, is formed of two separate sleeves 150*a*, 150*b* which are initially fixed together but may move axially relative to one another following shearing.

Figure 12:
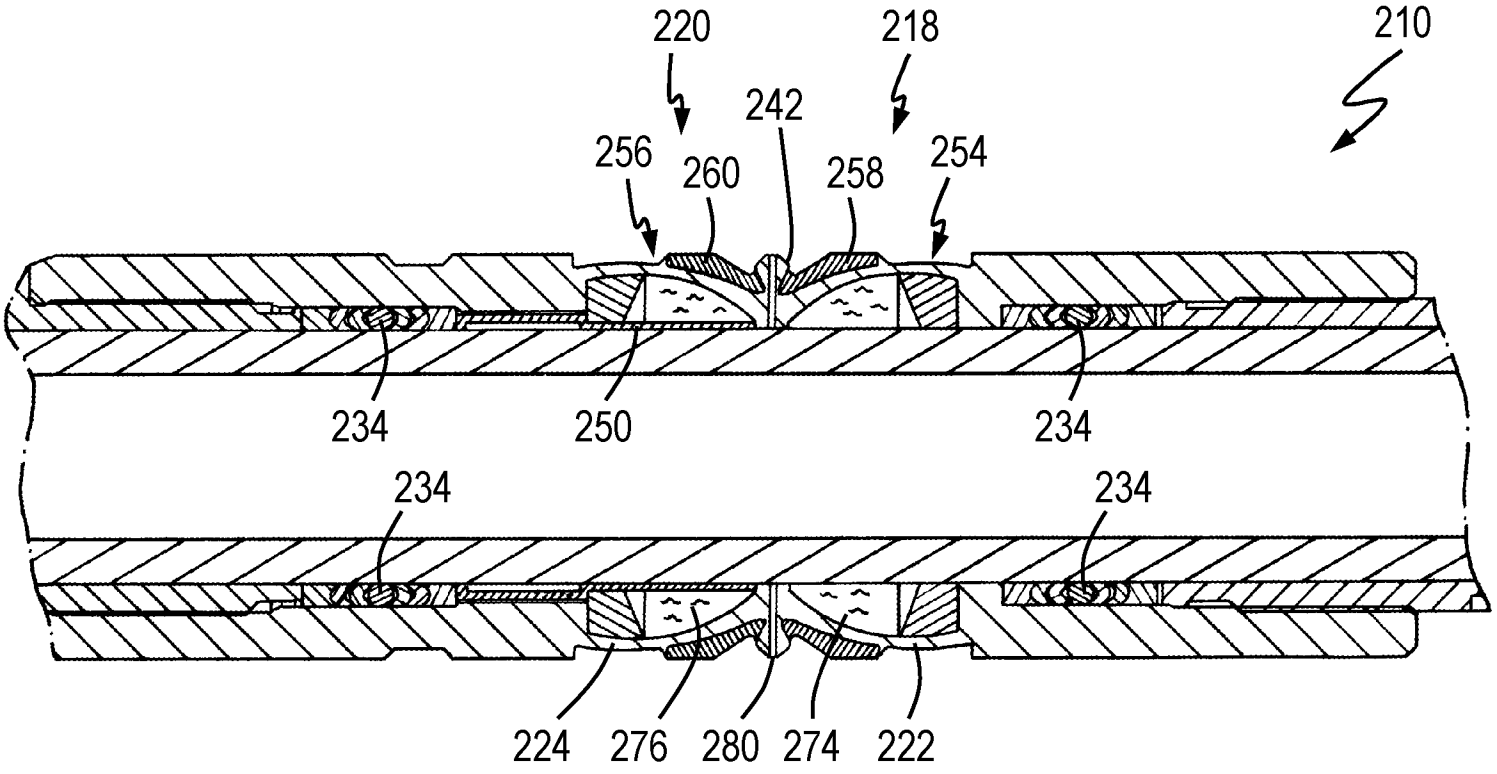
FIG. 12 is a sectional view of a seal arrangement in accordance with a third embodiment of the present invention, in an unset configuration.
Figure 13:
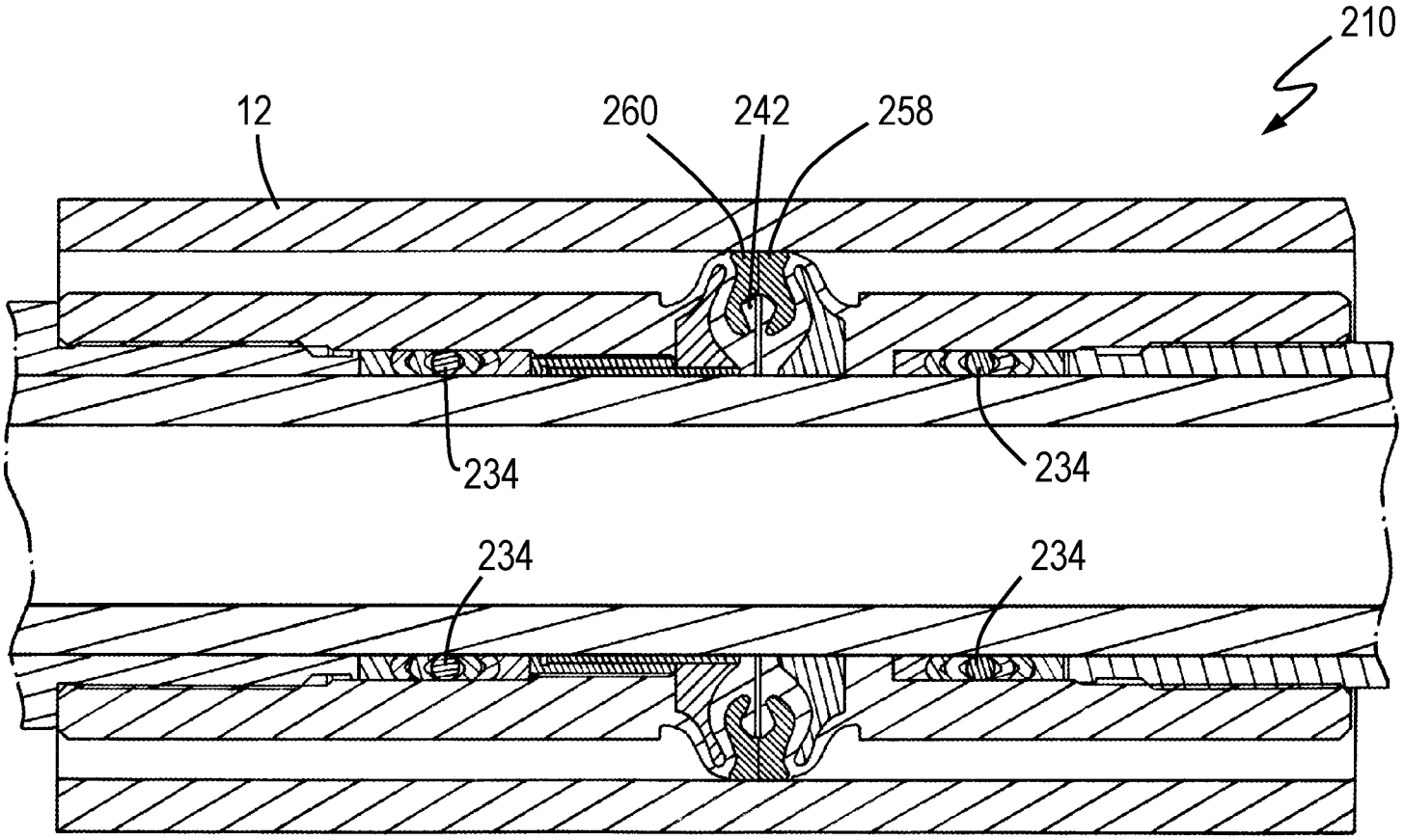
FIG. 13 shows the seal arrangement of FIG. 12, in a set configuration.

Reference is now made to FIGS. 12 and 13 of the drawings, which illustrate a sealing arrangement 210 in accordance with a third embodiment of the present invention. In particular FIG. 12 presents the sealing arrangement 210 in an unset configuration while FIG. 13 presents the sealing arrangement 210 in a set configuration. The seal arrangement 210 again shares many features with the seal arrangements 10 and 110 described above, and in the interests of brevity those common features will not be described again in any detail.

It will be noted that the respective enclosed volumes 254, 256 of the axially and circumferentially extending metal member 222, 224 are now only partially filled with the non-compressible but compliant material e.g. polytetrafluoroethylene (PTFE), granules or nano-ceramics. As shown in FIG. 12, the enclosed volumes 254, 256 may also comprise a grease 274, 276. The presence of the grease 274, 276 helps to prevent mechanical failure of the sealing elements 218, 220 due to hydrostatic pressures experienced during the deployment of the seal arrangement 210.

The seal arrangement 210 is sealingly engaged with the mandrel at both outer extremities by mandrel seals 234. This configuration presents a full annular piston to area to differential pressure from either direction, thus effectively: further axially compressing the sealing elements 218, 220 into increased sealing engagement with the bore wall; presenting a collapsing pressure regime to the seal arrangement 210 which is fully supported in collapse due to the PTFE filled void, and removes a potential burst regime on the sealing elements 218 when exposed to an uphole differential pressure, as is present within the previously described seal arrangements 10, 110.

A vent 280 provides a means a means of fluid communication to and from the enclosed volumes 254, thus providing an exhaust for the grease 274, 276 during compression of the respective sealing element 218, 220. Ejection of the grease 274, 276 during the compression process has the advantage of providing a means for flushing away unwanted well fluids and or solid debris from the seal apparatus 210. It may also act as a lubricant, thus enhancing the lifetime of the seal apparatus 210.

The outer surface of the rubber rings 258, 260 also now comprise a non-uniform profile (e.g. a tapered or scalloped profile). Shaping of the outer surface of the rubber rings 258, 260 in this manner is found to favourably bias the deformation of these components during setting of the respective sealing elements 218, 220.

It should also be noted that in the presently described sealing arrangement 210 the rubber rings 258, 260 abut the annular rib 242 when the sealing arrangement 210 is in the unset configuration of FIG. 12. An undercut in the annular rib 242 is employed to assist in locating the rubber rings 258, 260. This arrangement is beneficial as it removes the requirement to include O-rings 70, 72.

As can be seen from FIG. 13, when the seal apparatus 210 is set the rubber rings 258, 260 wrap around the annular rib 242 so enhancing the performance of the seal apparatus 210. At this time, the grease 274, 276 has been expelled from the respective enclosed volumes 254, 256 and the RIFE fully fills the deformed enclosed volumes 254, 256.

Figure 14:
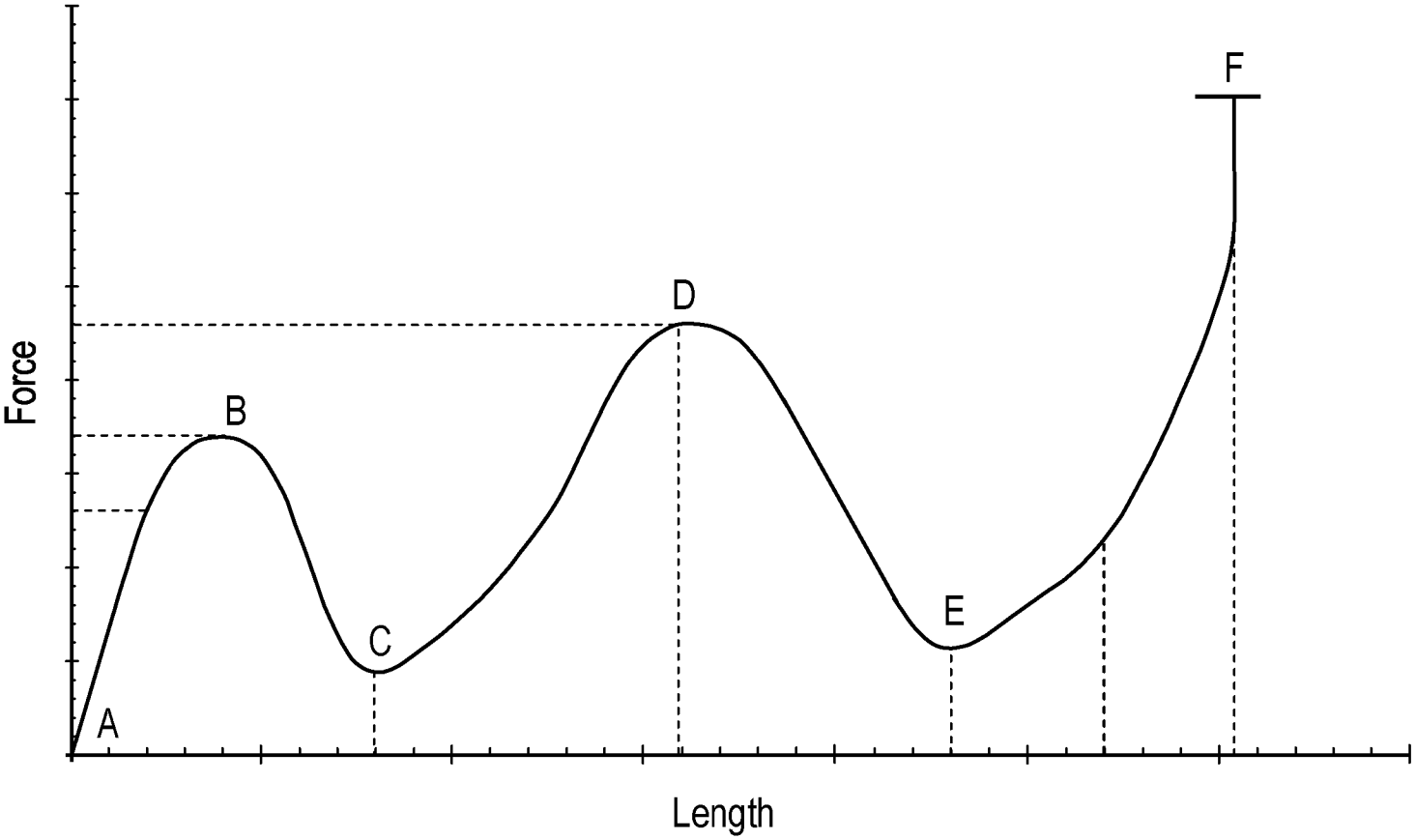
FIG. 14 is a graph illustrating the relationship between the setting force applied to the sealing elements of the seal arrangement of FIG. 12, and the degree of compression of the sealing elements.

FIG. 14 of the drawings, which is a graph illustrating the relationship between the setting force applied to the sealing elements 218, 220 and the degree of compression of the sealing elements 218, 220. The section of the graph between points A and B illustrates initial plastic deformation of the first sealing element 218 while Section B to C corresponds to the radially outwards deformation of the axially and circumferentially extending metal member 222. There then follows an initial degree of deformation of the RIFE within enclosed volume 254 until the outer surface of the member 222 contacts the casing at point D and the first sealing element 218 is fully set. This is followed by a further degree of compression until the shear sleeve 250 fails (section D to E), resulting in initiation of the setting of the second sealing element 220. At this point the compressive setting force is being applied to both sealing elements 218, 220, however as the first sealing element 218 is already fully-set, all of the associated deformation will be accommodated by the second sealing element 220, and the rubber rings 258, 260 unfil the element 220 arrives at fully set point F.

Figure 15:
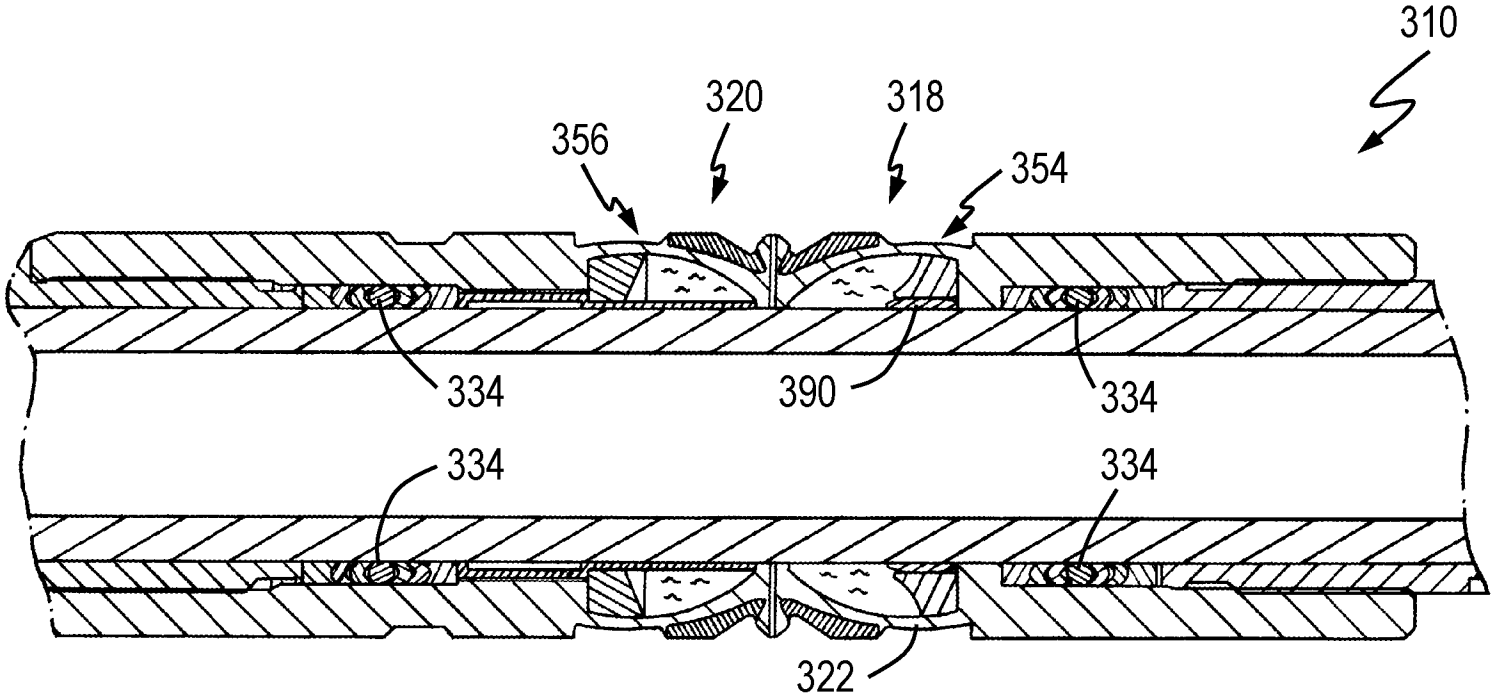
FIG. 15 is a sectional view of a seal arrangement in accordance with a fourth embodiment of the present invention, in an unset configuration.
Figure 16:
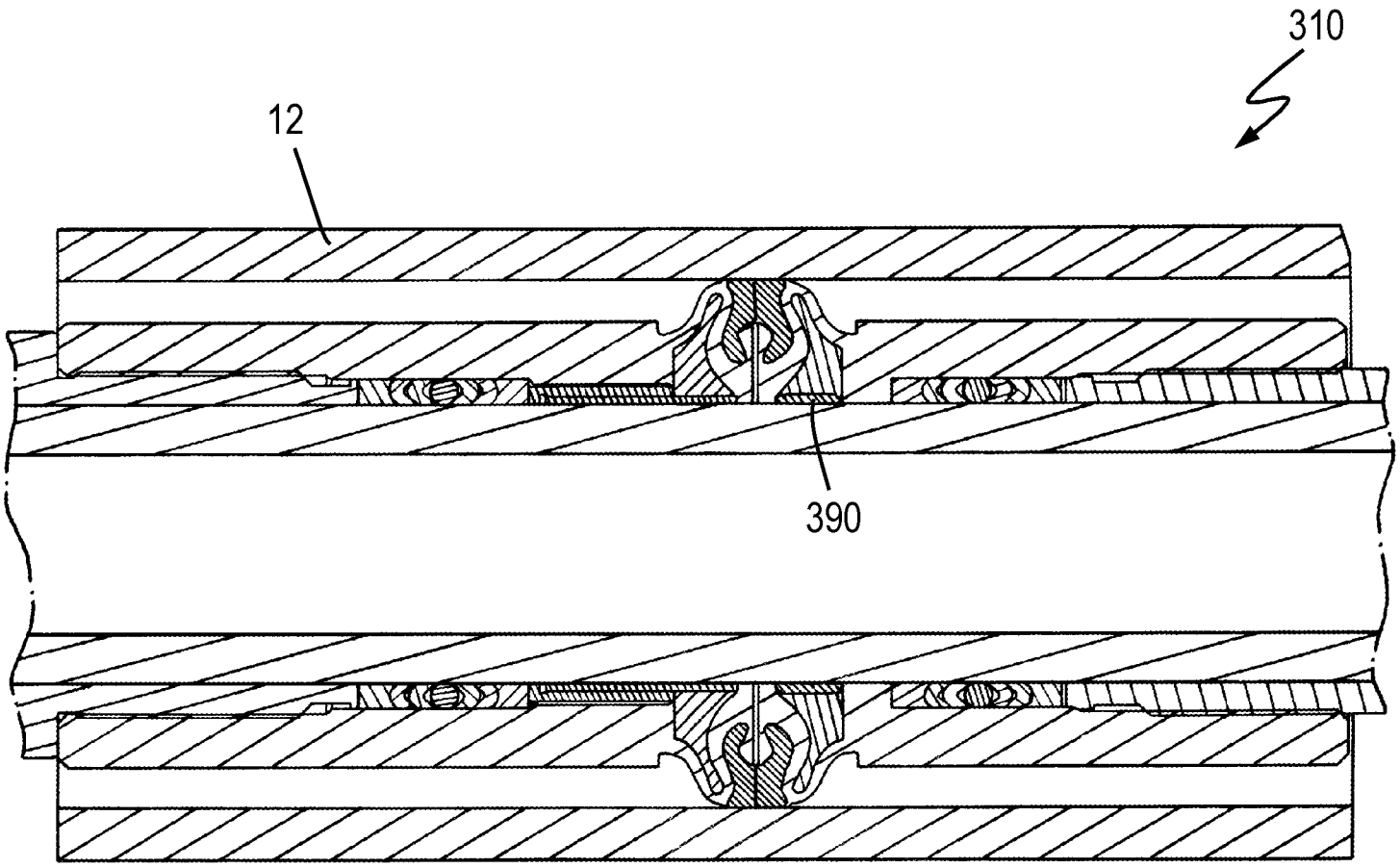
FIG. 16 shows the seal arrangement of FIG. 15, in a set configuration.

Reference is now made to FIGS. 15 and 16 of the drawings, which illustrate a sealing arrangement 310 in accordance with a fourth embodiment of the present invention. In particular FIG. 15 presents the sealing arrangement 310 in an unset configuration while FIG. 16 presents the sealing arrangement 310 in a set configuration. The seal arrangement 310 again shares many features with the seal arrangements 10, 110, 210 described above, and in the interests of brevity those common features will not be described again in any detail.

Figure 17:
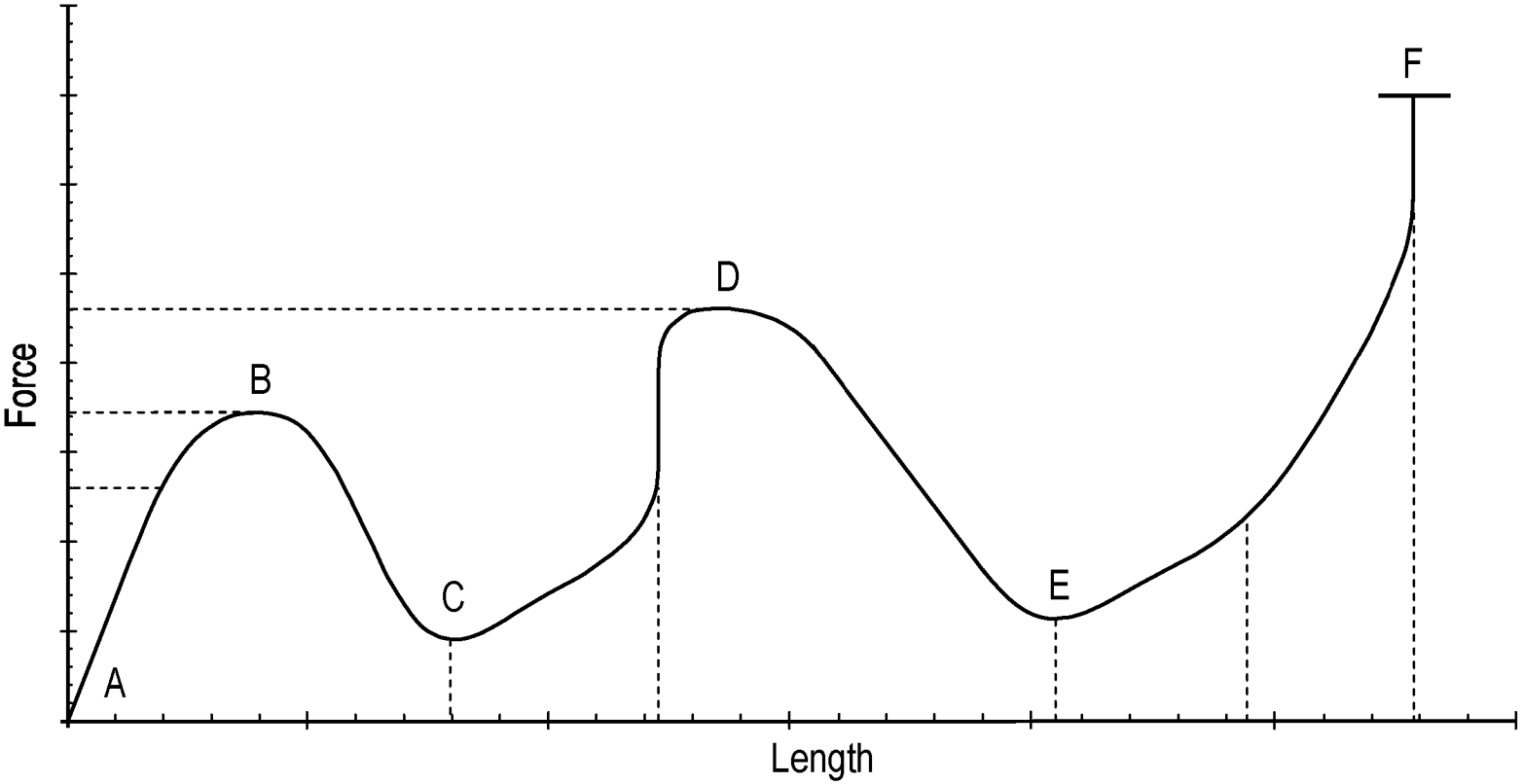
FIG. 17 is a graph illustrating the relationship between the setting force applied to the sealing elements of the seal arrangement of FIG. 15, and the degree of compression of the sealing elements.

The main difference between the sealing arrangement 210 and 310 is that the sealing arrangement 310 comprises a travel limiter, in the form of a solid ring 390 located within the within the enclosed volume 354. The solid ring 390 provides a means for preventing over extension of the axially and circumferentially extending member 322 during setting of the first sealing element 318. The impact of the solid ring 390 can be seen within the corresponding graph of FIG. 17 which illustrates the relationship between the setting force applied to the sealing elements 318, 320 and the degree of compression of the sealing elements 318, 320. In particular, the solid ring 390 results in the vertical section of the curve located between points C and D.

A sealing method and sealing arrangement is described The sealing arrangement comprises a body and first and second sealing elements mounted thereon. The sealing elements are each movable between a retracted configuration and an extended configuration and are configured to move from the retracted configuration to the extended configuration in response to an axial compression. The second sealing element is however maintained in its retracted configuration until the first sealing element has moved from its retracted configuration to its extended configuration. The sequential extension of the sealing elements can deform to assume the extended configuration under compression and the progression and the form of the deformation can be arranged to improve the quality of the seal achieved. An extended sealing element in engagement with the bore wall may also serve as an anchor or retainer and facilitate application of a compression force to an intermediate sealing element.

It will be apparent to those of skill in the art that the above described embodiments are merely exemplary of the present invention, and that various modifications and improvements may be made thereto without departing from the scope of the invention as defined by the appended claims.

The invention claimed is:

1. A seal arrangement comprising:

a body;

first and second sealing elements mounted on the body, each of the first and second sealing elements respectively:

being movable between a retracted configuration and an extended configuration, being configured to move from the retracted configuration to the extended configuration in response to axial compression, and comprising an extending member that:

is configured to extend axially and circumferentially, and includes an outer surface carrying a band or a volume of compressible material ("compressible material");

an annular rib that extends outwardly from the body and is positioned between the first and second sealing elements; and an O-ring positioned between a base of the annular rib and an end of one of the extending members;

wherein the second sealing element being maintained in the retracted configuration until the first sealing element has moved to the extended configuration;

wherein extending the first and second sealing elements brings surfaces of the compressible materials together in contact and over the annular rib to define an intermediate sealing element; and wherein the first and second sealing elements, in extended configurations, are configured to cooperate with the intermediate sealing element and define a unitary seal.

2. A seal arrangement as claimed in claim 1 further comprising an axial support member.

3. A seal arrangement as claimed in claim 2 wherein the axial support member restricts axial compression of the second sealing element or permits an axial compression force to bridge or bypass the second sealing element.

4. A seal arrangement as claimed in claim 2 wherein the axial support member includes a releasable or reconfigurable portion configured to shear or release under an application a predetermined force.

5. A seal arrangement as claimed in claim 2 wherein the axial support member extends between the body and the second sealing element.

6. A seal arrangement as claimed in claim 2 wherein the axial support member engages an end portion of the first sealing element.

7. A seal arrangement as claimed in claim 1 wherein the first and second sealing elements are compliant.

8. A seal arrangement as claimed in claim 1 wherein the first and second sealing elements are symmetrical about a lateral plane.

9. A seal arrangement as claimed in claim 1 wherein the first and second sealing elements are provided in a back-to-back arrangement.

10. A seal arrangement as claimed in claim 1 wherein one or both ends of the extending members are one of fixed and anchored such that the ends do not radially translate as the respective extending member deforms.

11. A seal arrangement as claimed in claim 10 wherein the extending members are mounted between end rings.

12. A seal arrangement as claimed in claim 11 wherein the extending members share a common end ring.

13. A seal arrangement as claimed in claim 10 wherein one or both ends of the extending members are located towards an outer diameter of the seal arrangement.

14. A seal arrangement as claimed in claim 4 wherein extending the first and second sealing elements brings the O-ring into contact with the compressible material carried by the one of the extending members.

15. A seal arrangement as claimed in claim 1 wherein the extending members are formed from a single piece of material.

16. A seal arrangement as claimed in claim 15 wherein single piece of material incorporates end rings.

17. A seal arrangement as claimed in claim 1 wherein an internal surface of at least one of the extending members is spaced from an outer surface of the body to define a volume.

18. A seal arrangement as claimed in claim 17 wherein the volume is filled with a deformable material.

19. A seal arrangement as claimed in claim 17 wherein the volume is partially filled with a deformable material.

20. A seal arrangement as claimed in claim 19 wherein the volume is partially filled with a fluid.

21. A seal arrangement as claimed in claim 17 wherein at least one of the first and second sealing elements comprise a vent.

22. A seal arrangement as claimed in claim 17 wherein a travel limiter is located within the volume.

23. A seal arrangement as claimed in claim 1 wherein the compressible material is configured to facilitate a predetermined deformation of the extending members.

24. A seal arrangement as claimed in claim 23 wherein the seal arrangement includes a substantially non-deformable portion configured to do at least one of support at least a portion of the compressible material and limit or control deformation of the compressible material.

25. A seal arrangement as claimed in claim 23 wherein the compressible material has a generally triangular section.

26. A seal arrangement as claimed in claim 23 wherein an outer surface of the compressible material is substantially cylindrical within the first and second sealing elements.

27. A seal arrangement as claimed in claim 23 wherein the outer surface of the respective compressible material comprises a non-uniform profile for biasing the deformation of the compressible material during setting of the first and second sealing elements.

28. A seal arrangement as claimed in claim 1 wherein at least one of the extending members includes a circumferentially-extending outer lip.

29. A seal arrangement as claimed in claim 1 further comprising a locking arrangement to retain the seal arrangement in a set configuration.

30. A seal arrangement as claimed claim 1 wherein an end of the compressible material carried by the one of the extending members defines a fluid relief port.

* * * * *